United States Patent [19]

MacEachern et al.

[11] Patent Number: 4,855,885

[45] Date of Patent: Aug. 8, 1989

[54] LIGHT BEAM INTENSIFIER

[75] Inventors: Donald C. MacEachern, Montreal; Gaston Levesque, Quebec, both of Canada

[73] Assignee: DSL Dynamic Sciences Limited, St. Laurent, Canada

[21] Appl. No.: 179,954

[22] Filed: Apr. 11, 1988

[51] Int. Cl.[4] ..... F21V 7/02

[52] U.S. Cl. ..... 362/298; 362/301; 362/302

[58] Field of Search ..... 362/76, 77, 296, 297, 362/298, 346, 263, 300, 301, 302, 299

[56] References Cited

U.S. PATENT DOCUMENTS

| | | | |
|---|---|---|---|
| 1,776,481 | 2/1929 | Smart . | |
| 2,993,987 | 7/1961 | Diffie | 362/298 |
| 3,443,086 | 5/1969 | Rikis | 240/41.1 |
| 3,562,623 | 2/1971 | Farnsworth | 321/2 |
| 3,749,906 | 7/1973 | Thiry | 362/301 |
| 4,312,029 | 1/1982 | Zellmer | 363/21 |
| 4,378,583 | 3/1983 | Caprari | 362/263 |
| 4,422,135 | 12/1983 | McCamy | 362/346 |
| 4,495,552 | 1/1985 | Graff | 362/346 |
| 4,544,999 | 10/1985 | Kawanami et al. | 362/298 |
| 4,669,036 | 5/1987 | Cowett, Jr. | 363/21 |
| 4,677,534 | 6/1987 | Okochi | 363/21 |
| 4,680,688 | 7/1987 | Inou et al. | 363/21 |
| 4,683,528 | 7/1987 | Snow et al. | 363/21 |
| 4,755,916 | 7/1988 | Collins | 362/298 |
| 4,760,498 | 7/1988 | Lang et al. | 362/298 |

*Primary Examiner*—Ira S. Lazarus
*Assistant Examiner*—Sue Hagarman
*Attorney, Agent, or Firm*—Christensen, O'Connor, Johnson & Kindness

[57] ABSTRACT

A light beam intensifier (10) having a paraboloidal reflector (12) a mirror (14) a single light tube (16) and window (18). The mirror (14) is placed forward of the forcal point f of the reflector (12) and has the light tube (16) affixed thereto to be positioned coincident with the focal point f. As the light tube (16) is energized, light rays (52) emanating directly therefrom are reflected from the parabolic reflector (12) to form a first beam path and the forward shining light rays (54) are reflected from the reflective surface (34) of the mirror (14) to be reflected off the paraboloidal reflector (12) to form a composite light beam path (56) having a predetermined pattern.

16 Claims, 3 Drawing Sheets

LIGHT BEAM INTENSIFIER

TECHNICAL FIELD

The present invention relates to optical devices for directing beams of light, and, more particularly to a light beam intensifier for forming a composite light beam having a predetermined pattern from a single source of light in an energy efficient manner.

BACKGROUND OF THE INVENTION

While the present invention was developed for use in the railroad industry, and is described in this environment, it is to be understood that the invention can be used in other environments where it is necessary to provide a high efficiency marker light that forms a solid cone-shaped beam path that can be constructed and operated at low cost. More particularly, the present invention is ideally suited to applications where such a marker light must efficiently use a limited supply of electrical energy.

High visibility marker lights are used in the railroad industry as warnings of obstructions to train engineers. Typically, these marker lights are installed on the last car of a train to warn engineers in oncoming trains of the presence of a preceding train on the track.

Because trains travel at high rates of speed, and because regulations in many countries frequently require the rear marker lights of trains to be red, red-orange, or some variation thereof, the marker light must be sufficiently bright to be seen at a great distance in order to permit the engineer of an oncoming train to slow the train down in time. In addition, because many railroad tracks pass over hilly terrain, the rear marker light must project a solid cone of light of sufficient brightness along a beam path wide enough and tall enough to be visible to oncoming trains around curves, as well as at the crest of hills or in the troughs of valleys. To permit extended use when powered by batteries, these lights must use minimum energy to produce the requisite beam pattern and brightness. Consequently, there is a need for a high visibility marker light that meets the aforementioned requirements.

SUMMARY OF THE INVENTION

In accordance with the present invention, a light beam intensifier for providing a high-intensity composite light beam from a single source of light is provided. The intensifier includes a first reflector having a parabolic-shaped reflecting surface with a focal point located forward of the reflecting surface; and a second reflector positioned forward of the focal point having a reflecting surface oriented to face toward the reflecting surface of the first reflector such that light radiating from a source positioned between the reflecting surface of the first reflector and the reflecting surface of the second reflector is reflected from the first reflector to form a first light beam and is further reflected from the second reflector onto the first reflector to form a second light beam that combines with the first light beam to thereby form a composite light beam having a predetermined pattern.

In accordance with another aspect of the present invention, the light source is preferably positioned adjacent the reflecting surface of the second reflector and coincident with the focal point of the first reflector.

In accordance with another aspect of the present invention, the predetermined pattern of the composite light beam is in the shape of a solid cone of light emanating from the light source and symmetrically formed about a longitudinal axis such that most or all of the light produced by the source is contained within this cone. Preferably, the cone has a substantially elliptical cross-sectional shape with a vertical dimension of a minimum of $\pm 5°$ with respect to the longitudinal axis and a horizontal dimension of a minimum of $\pm 15°$ with respect to the longitudinal axis of the composite light beam.

In accordance with still yet another aspect of the present invention, the second reflector has a parabolically-shaped reflecting surface.

In accordance with a further aspect of the present invention, the first reflector has a parabolic reflecting surface.

As will be readily appreciated from the foregoing description, the present invention provides a light beam intensifier for use with marker lights and the like that forms a high-intensity composite light beam from a single light source. This is achieved through the use of an elongated light tube and two reflecting surfaces that are economically and easily constructed. The second reflector, placed forward of the light tube, projects the light tube profile onto the paraboloidal reflector to further intensify the light projected directly from the light tube. This results in the light being contained in a solid, cone-shaped light beam that can then be tailored through repositioning of the second reflector and the light source with respect to the position of the focal point of the paraboloidal reflector to achieve the desired vertical and horizontal light beam dimensions. This is ideally suited for use with marker lights on trains where the beam path must be visible around curved tracks and on hilly terrain. The present invention is also useful in other applications requiring a very efficient, low-cost light having high visibility.

BRIEF DESCRIPTION OF THE DRAWINGS

The foregoing features and advantages of the present invention will be more readily appreciated as the same becomes better understood by reference to the following detailed description, when taken in conjunction with the accompanying drawings, wherein.

DETAILED DESCRIPTION OF THE PREFERRED EMBODIMENT

Figure 1:
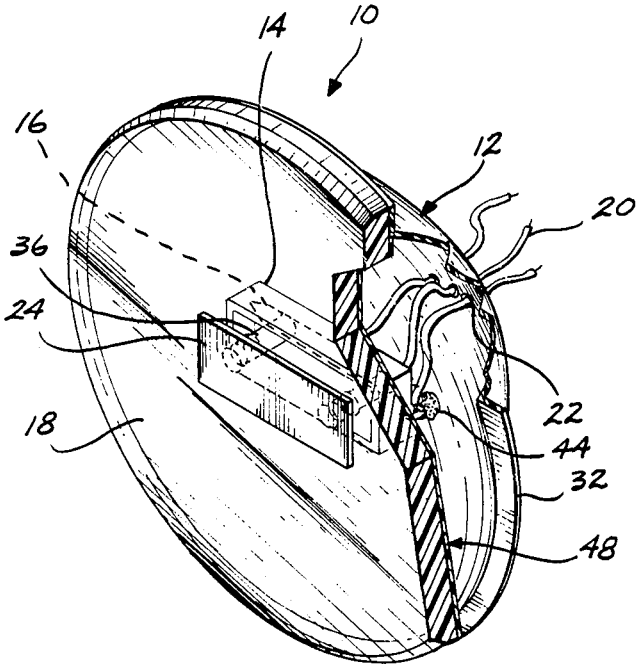
FIG. 1 is an isometric view of a light beam intensifier formed in accordance with the present invention.
Figure 2:
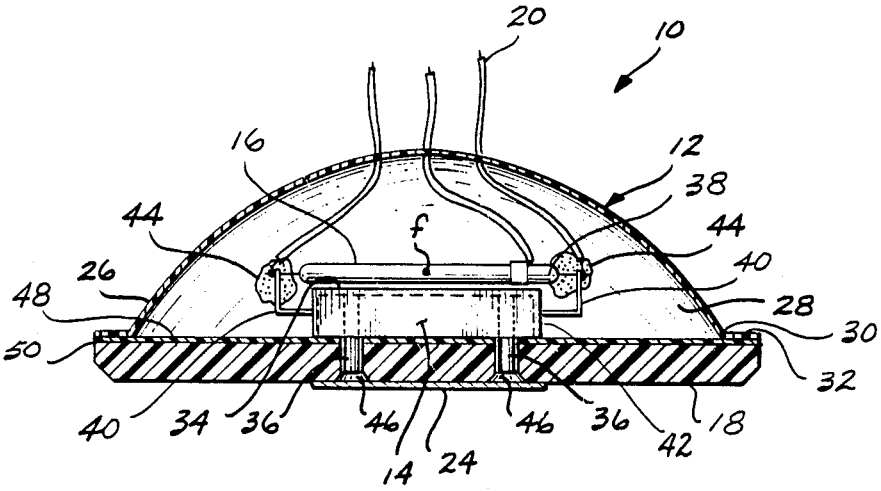
FIG. 2 is a cross-sectional top view of the light beam intensifier of FIG. 1.

Referring initially to FIGS. 1 and 2, a light beam intensifier 10 is shown having a paraboloidal reflector 12, a mirror 14, a light tube 16 and a window 18. Three wire leads 20 attached to the light tube 16 exit through openings 22 in the parabolic reflector 12. A decorative label 24 is applied to the window 18 to conceal the mirror 14 from the exterior.

The paraboloidal reflector 12 comprises an exterior surface 26 and an interior reflector surface 28. The reflector 12 also includes a forward facing rim 30 having a circumscribing flange 32 that projects radiallyoutward from the rim 30. Preferably, the reflector 12 is constructed of high impact material that is plated with a highly reflective coating to gige it high reflectivity although the reflector 12 may also be constructed of other materials, such as metal. The diameter of the reflector 12, as measured across the rim 30, is preferably 3.7 inches and is approximately 1 inch deep, as measured from the rim. The flange 32 projects approximately ¼ inch further beyond the rim. The coordinates for the paraboloid of revolution are generated by the formula $y^2=4fx$, with the focal point f being located at 0.843 inches forward of the reflecting surface 28. The x and y coordinates of the paraboloid generated by the formula are listed below:

| y | x | y | x |
|---|---|---|---|
| 0.000 | 0.000 | 1.000 | 0.297 |
| 0.050 | 0.001 | 1.050 | 0.327 |
| 0.100 | 0.003 | 1.100 | 0.359 |
| 0.150 | 0.007 | 1.150 | 0.392 |
| 0.200 | 0.012 | 1.200 | 0.427 |
| 0.250 | 0.019 | 1.250 | 0.463 |
| 0.300 | 0.027 | 1.300 | 0.501 |
| 0.350 | 0.036 | 1.350 | 0.540 |
| 0.400 | 0.047 | 1.400 | 0.581 |
| 0.450 | 0.060 | 1.450 | 0.624 |
| 0.500 | 0.074 | 1.500 | 0.667 |
| 0.550 | 0.090 | 1.550 | 0.712 |
| 0.600 | 0.107 | 1.600 | 0.759 |
| 0.650 | 0.125 | 1.650 | 0.807 |
| 0.700 | 0.145 | 1.700 | 0.857 |
| 0.750 | 0.167 | 1.750 | 0.908 |
| 0.800 | 0.190 | 1.800 | 0.961 |
| 0.850 | 0.214 | 1.836 | 1.000 |
| 0.900 | 0.240 | 1.850 | 1.015 |
| 0.950 | 0.268 | | |

The mirror 14 is in the shape of a rectangular block having a planar-shaped reflecting surface 34 that is finished with vacuum-plated chrome for high reflectivity. Two mounting legs 36 project from the opposite side of the reflecting surface 34 for mounting the mirror 14 to the window 18. Preferably, the mirror 14 is constructed of plastic utilizing a suitable forming process.

The light tube 16 is an elongated gas-discharge flash tube having ends 38 through which the wire leads 20 pass. The light tube 16 is held in place immediately adjacent the reflecting surface 34 of the mirror 14 by a fork 40 projecting from each side 42 of the mirror 14. The forks 40 are bent at a 90° angle as they exit the mirror 42. The ends 38 of the light tube 16 are attached to the forks 40 by a clear silicon adhesive 44. To achieve the brightest light at the greatest efficiency, a xenon gas-discharge flash tube is preferably used.

The window 18 is constructed in the shape of a flat disc, preferably from transparent acrylic plastic. Two holes 46 are drilled through the window 18 and are sized and shaped to receive the mounting legs 36 on the mirror 14. A colored filter 48 color is applied to one side, preferably the interior side 50, of the window 18 to filter the light exiting from the reflector 12. It is to be understood that a filter is not necessary to practice the invention, but may be used as needed.

To assemble the light beam intensifier 10, the filter 48, if required, is placed against the interior side 50 of the window 18. The mirror 14 is then mounted to the window 18 by inserting the mounting legs 36 through the holes 46 in the window 18. The mounting legs 36 are held in place with a suitable bonding material. The decorative label 24 is applied ove the holes 46 to conceal the mounting of the mirror 14. This assembly is then placed on the parabolic reflector 12 with the window 18 and filter 48 bonded with suitable adhesive to the flange 32. As previously noted, the wire leads 20 pass through the openings 22 in the reflector 12.

Because an elongated tubular light is used as a light source, the composite light beam will have an elliptical cross-sectional shape. Furthermore, the light will be substantially contained within a solid, cone-shaped beam path of predetermined dimensions.

Figure 3:
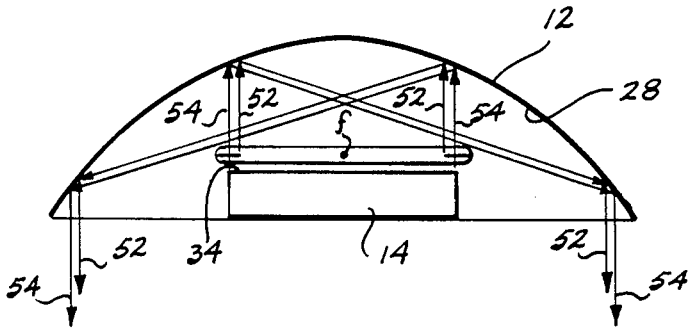
FIG. 3 is a pictorial top view illustrating the operation of the light beam intensifier.

FIG. 3 illustrates the operation of the light beam intensifier 10. Each time the light tube 16 is illuminated, the light rays 52 emanating therefrom are reflected directly off the parabolic reflector 12 to form a first beam path, as defined by the light rays 52. In addition, each time the light tube 16 is illuminated, its forward shining light rays are prevented from shining directly forward by the presence of the mirror 14. Rather, the forward shining light rays 54 are reflected off the reflective surface 34 of the mirror 14. The light rays 54 are in turn reflected from the parabolic reflector 12 to form a second light beam path defined by the light rays 54 that combines with the first light beam path formed by the light rays 52 to form a composite light beam path. As a result, the light normally shining forward from the light tube 16 is not wasted by dispersing outside of the beam path, but it is directed by the mirror 14 and the parabolic reflector 12 to travel in combination with the reflected light rays 52.

Figure 4A:
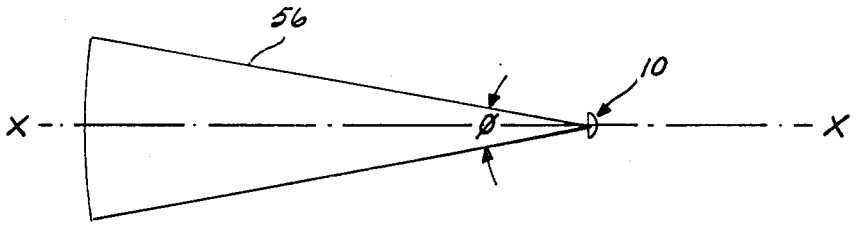
FIGS. 4A–B are top and side views, respectively, illustrating the angular dimensions of the solid, cone-shaped composite light beam.
Figure 4B:
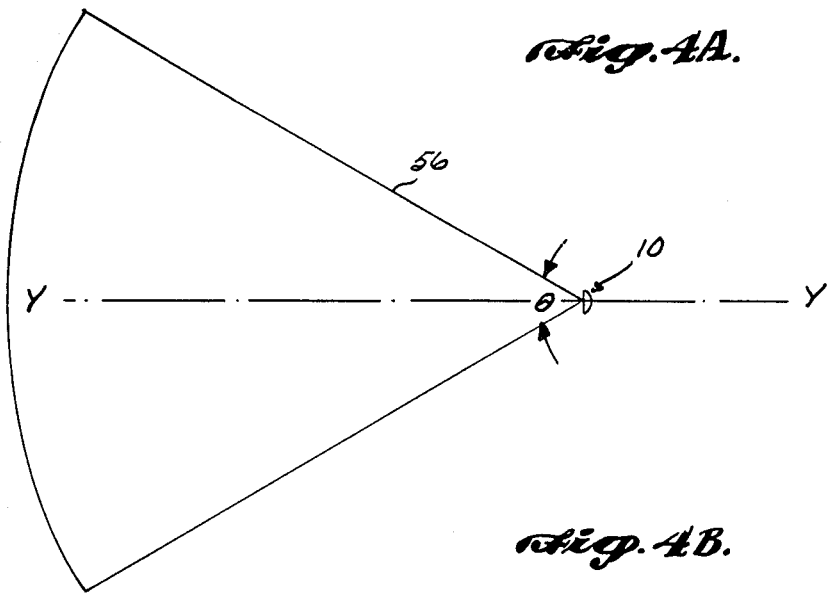

Inasmuch as the preferred embodiment is designed for use with railroads, the composite light beam pattern must meet certain regulatory requirements with respect to vertical and horizontal beam dimensions. In FIG. 4A, the light beam intensifier 10 is shown in side view forming a composite light beam 56 that shines along the longitudinal axis X. A top view of the same composite light beam 56 is shown in FIG. 4B. Angle $\phi$ in FIG. 4A represents the vertical dimensions of the composite light beam 56 and angle $\theta$ in FIG. 4B represents the horizontal dimension of the composite light beam 56. In one railroad application, the vertical illumination of the marker light must not be less than 50 candela at $\pm 5°$ from the longitudinal axis. In this case, $\phi$ would equal 10°. in addition, the horizontal illumination of the marker light must not be less than 50 candela at $\pm 15°$ from the x axis, which means in this case the angle $\theta$ would be 30°.

All of these requirements can be met in the present invention by correctly positioning the light tube 16 and the mirror 14 with respect to the focal point f. It has been found through testing that the composite light beam 56 will have an illumination of at least 50 candela at the periphery of the vertical dimension of 10° and a horizontal dimension of 30° when the light tube 16 is positioned in the focal plane of the parabolic reflector 12 as indicated by the focal point f and the reflective surface 34 is in contact with the light tube 16. The beam pattern and dimensions may be altered by repositioning the light tube 16 and the mirror 14 with respect to the focal plane of the paraboloidal reflector 12.

It is to be understood, of course, that the amount of illumination of the composite light beam 56 will also be a function of the brightness of the light flash produced by the light tube 16. In the present application, the light tube 16 is energized by a capacitor discharge circuit that allows a capacitor to discharge through the light tube. A trigger circuit and a high voltage transformer are used to generate a high voltage pulse to energize the light tube 16 approximately once every second. Inasmuch as this circuit is generally known in the art, it will not be described in great detail here.

While the present invention has been described in its application in the railraod industry, it is to be understood that the light beam intensifier formed in accordance with the present invention will have other applications where a light beam contained within a specific predetermined pattern is desired. For instance, the light beam intensifier is particularly suitable for highway, marine, aircraft, space, and other transportation applications as a warning device. More particularly, the present invention will have particular application to situations in which power must be used efficiently, such as with batteries, solar cells, etc. In addition, it is to be understood that the present invention will work with other sources of light such as incandescent lamps that are both flashing or are constantly illuminated. Furthermore, the dimensions of the cone of light may be varied according to the needs of the intended application.

Although a preferred embodiment of the invention has been illustrated and described herein, it will be appreciated that various changes and modifications may be made without departing from the spirit and scope of the invention. For instance the mirror 14 may have a parabolically-shaped reflecting surface instead of a planar reflecting surface. Furthermore, the reflector 12 may have a parabolically-shaped reflecting surface instead of a paraboloid of revolution. Consequently, the invention can be constructed and practiced otherwise than as illustrated herein.

The embodiments of the invention in which an exclusive property or privilege is claimed are defined as follows:

1. A light beam intensifier comprising:

a first reflector having a parabolic-shaped reflecting surface and a focal point located forward of said reflecting surface; and a highly reflective second reflector positioned forward of said focal point, said second reflector having a reflecting surface oriented to face toward the reflecting surface of said first reflector such that light radiating from a light source positioned coincident with said focal point and adjacent the reflecting surface of said second reflector is reflected from said first reflector to form a first light beam and completely reflected from said second reflector onto said first reflector to form a second light beam that combines with said first light beam to thereby form a composite light beam having a predetermined pattern.

2. The intensifier of claim 1, further including a window means positioned forward of said second reflector.

3. The intensifier of claim 2, wherein said window means supports said light source and said second reflector.

4. The intensifier of claim 1, wherein the predetermined pattern of said composite light beam has a substantially elliptical cross-sectional shape that is symmetrical about a longitudinal axis.

5. The intensifier of claim 1, wherein the predetermined pattern of said composite light beam is a solid, cone-shaped beam having a substantially elliptical, cross-sectional shape that is symmetrical about a longitudinal axis.

6. The intensifier of claim 5, wherein said light source has an elongated tubular shape.

7. The intensifier of claim 5, wherein said composite light beam has a vertical dimension of $\pm 5°$ from the longitudinal axis and a horizontal dimension of $\pm 15°$ from the longitudinal axis of the composite light beam.

8. The intensifier of claim 5, wherein said second reflector has a parabolically-shaped reflecting surface.

9. A light beam intensifier comprising:

a first reflector having a longitudinal axis and a paraboloidal reflecting surface with a focal point located a predetermined distance forward of the reflecting surface, said reflective surface defining a beam path shining along the longitudinal axis for light reflected therefrom; and a highly reflective second reflector positioned forward of the reflecting surface and in axial alignment with said focal point such that light emanating from a light source positioned coincident with the focal point and adjacent the reflecting surface of said second reflector is reflected directly from said first reflector along the beam path and further completely reflected from said second reflector to said first reflector and then reflected along the beam path to form a composite beam of light having a predetermined pattern.

10. The intensifier of claim 9, wherein said light source has an elongated tubular shape.

11. The intensifier of claim 9, further comprising a window means positioned forward of said second reflector.

12. The intensifier of claim 11, wherein said beam path has an elliptical cross-sectional shape that is symmetrical about the longitudinal axis.

13. The intensifier of claim 12, wherein said beam path has a vertical dimension of $\pm 5°$ with respect to the longitudinal axis and a horizontal dimension of $\pm 15°$ with respect to the longitudinal axis.

14. The intensifier of claim 11, wherein said second reflector has a parabolically-shaped reflecting surface.

15. The intensifier of claim 14, wherein said beam path has an elliptical cross-sectional shape that is symmetrical about the longitudinal axis.

16. The intensifier of claim 15, wherein said beam path has a vertical dimension of $\pm 5°$ with respect to the longitudinal axis and a horizontal dimension of $\pm 15°$ with respect to the longitudinal axis.

* * * * *

UNITED STATES PATENT AND TRADEMARK OFFICE

CERTIFICATE OF CORRECTION

PATENT NO. :4,855,885

DATED :August 8, 1989

INVENTOR(S) :D.C. MacEachern et al.

It is certified that error appears in the above-identified patent and that said Letters Patent is hereby corrected as shown below:

Column 1, line 6, "particularly" should be --specifically--;

Column 1, line 30, "light" should be --lights--;

Column 2, line 15, "parabolic" should be --paraboloidal--;

Column 3, line 3, "gige" should be --give--;

Column 3, line 67, "ove" should be --over--;

Column 4, line 44, "in" should be --In--.

Signed and Sealed this

Twenty-fourth Day of July, 1990

*Attest:*

HARRY F. MANBECK, JR.

*Attesting Officer*

*Commissioner of Patents and Trademarks*